United States Patent [19]

Stempeck

[11] 4,369,395

[45] Jan. 18, 1983

[54] ELECTRONIC FLASH WITH SAFETY SWITCH FEATURE

[75] Inventor: John W. Stempeck, Reading, Mass.

[73] Assignee: Polaroid Corporation, Cambridge, Mass.

[21] Appl. No.: 240,761

[22] Filed: Mar. 5, 1981

[51] Int. Cl.[3] ..... H05B 41/32

[52] U.S. Cl. ..... 315/241 P; 307/328; 315/240; 362/10

[58] Field of Search ..... 315/240, 241 P, 362; 362/10; 328/7; 354/145; 307/326, 328; 320/1

[56] References Cited

U.S. PATENT DOCUMENTS

| | | | |
|---|---|---|---|
| 2,283,729 | 5/1942 | Gage | 315/129 X |
| 2,779,879 | 1/1957 | Spiece | 307/328 |
| 3,921,034 | 11/1975 | Nakamura | 315/241 P |
| 3,969,737 | 7/1976 | Kendrick | 354/145 X |
| 4,063,108 | 12/1977 | Klett et al. | 307/64 |
| 4,160,174 | 7/1979 | Zucker | 307/328 |
| 4,196,458 | 4/1980 | Kondo | 362/10 |
| 4,204,140 | 5/1980 | Willis | 328/7 X |
| 4,251,753 | 2/1981 | Kondo | 315/241 P X |
| 4,255,691 | 3/1981 | Inagaki et al. | 315/241 P |

*Primary Examiner*—Eugene R. LaRoche
*Attorney, Agent, or Firm*—Edward S. Roman

[57] ABSTRACT

A safety switch arrangement is provided for an electronic flash for automatically discharging the main storage capacitor in response to the user deliberately or inadvertently removing the cover from the flash housing. The electronic flash is of any ordinary type comprising a DC-to-DC converter with a step-up transformer and the safety switch arrangement is connected to discharge the main storage capacitor through the secondary winding of the DC-to-DC converter transformer thereby eliminating the need for a separate bleeder resistor.

2 Claims, 5 Drawing Figures

ELECTRONIC FLASH WITH SAFETY SWITCH FEATURE

BACKGROUND OF THE INVENTION

1. Field of the Invention

This invention relates to a safety circuit for an electronic flash and, more particularly, to a safety circuit for eliminating any danger of shock or injury in the event that the cover from an electronic flash should be removed.

2. Description of the Prior Art

Electronic flash units typically employ large capacitors for storing electrical energy that is used for firing a flashtube. A DC-to-DC converter circuit which is energized from a low voltage battery typically in the order of 6 volts charges the storage capacitor in a known manner to a high voltage generally above 300 volts. If a flash unit user should either deliberately or accidentally remove the cover from the flash unit and thereafter contact the terminals of the charged storage capacitor, discharge current from the capacitor could produce serious injury.

It is well known in the art for electronic flash units to include a safety circuit for discharging the storage capacitor to protect users against injury. One such safety circuit is disclosed in U.S. Pat. No. 3,969,737, entitled "Electronic Flash Unit for Cameras Adapted to Receive Flashbulbs", by E. Kendrick, issued July 13, 1976, and shows an electronic flash unit having a circuit, the sole purpose of which is to discharge the storage capacitor to prevent accidental injury to the user. Circuits of this type generally include a normally open switch in series with a bleeder resistor, the switch and resistor being connected parallel to the main storage capacitor. The switch is closed automatically whenever the housing of the flash unit is opened thereby discharging the storage capacitor through the switch and the resistor. Although circuits of this type have been found to operate reliably, the bleeder resistor must be able to handle the high discharge current from the storage capacitor; and, since the resistor is required solely as a safety feature, it introduces an additional complexity and cost to the flash unit.

Other safety circuits for discharging storage capacitors in electronic flashes have utilized the quench tube in a quench strobe in place of an additional bleeder resistor as is fully described in U.S. Pat. No. 4,204,140, entitled "Safety Circuit for Electronic Flash Apparatus", by R. Willis, issued May 20, 1980. Although the safety circuit of the Willis patent eliminates the need for providing an additional bleeder resistor, it is nevertheless only applicable to electronic flash units of the quench type, and would not be applicable to electronic flash units of the non-quench type.

Therefore, it is a primary object of this invention to provide a safety circuit for discharging the main storage capacitor in an electronic flash of either the quench or non-quench type without utilizing any additional components other than a safety switch.

It is a further object of this invention to provide a safety circuit for discharging the storage capacitor in an electronic flash of either the quench or the non-quench type without providing an additional bleeder resistor.

Other objects of the invention will in part be obvious and will in part appear hereinafter. The invention accordingly comprises the mechanism and system possessing the construction, the combination of elements and the arrangement of parts which are exemplified in the following detailed disclosure.

SUMMARY OF THE INVENTION

A safety switch circuit is provided for an electronic flash of the type which normally comprises a flash discharge tube, a storage capacitor, means responsive to an applied DC voltage for charging the storage capacitor, and circuit means responsive to an applied trigger signal for discharging the storage capacitor through the discharge tube to produce an illuminating flash of light. The means for charging the storage capacitor comprises a transformer having a primary winding energized with an alternating voltage derived from the applied DC voltage and a secondary winding energized with an alternating voltage to provide the charging current to the storage capacitor. The electrical components including the storage capacitor are contained within a housing having a main body portion for supporting the various electrical components of the electronic flash and a cover portion which may be removably connected to the main body portion to cover the electrical components contained therein, particularly the storage capacitor. The safety switch circuit of this invention is provided for discharging the storage capacitor in response to removal of the cover portion of the housing from the main body portion. The safety switch circuit includes a safety switch stationed with respect to the housing so as to assume an opened circuit condition when the cover portion of the housing is connected to the main body portion and a closed circuit condition when the cover portion of the housing is disconnected from the main body portion. The safety switch is also electrically connected with respect to the secondary winding of the transformer and the storage capacitor so as to establish a discharge path for the storage capacitor through the secondary winding when the safety switch is in its closed circuit condition.

DESCRIPTION OF THE DRAWINGS

The novel features that are considered characteristic of the invention are set forth with particularity in the appended claims. The invention itself, however, both as to its organization and its method of operation, together with other objects and advantages thereof, will be best understood from the following description of the illustrated embodiment or when read in connection with the accompanying drawings where like members have been employed in the different figures to note the same parts and wherein:

DESCRIPTION OF THE PREFERRED EMBODIMENTS

Figure 1:
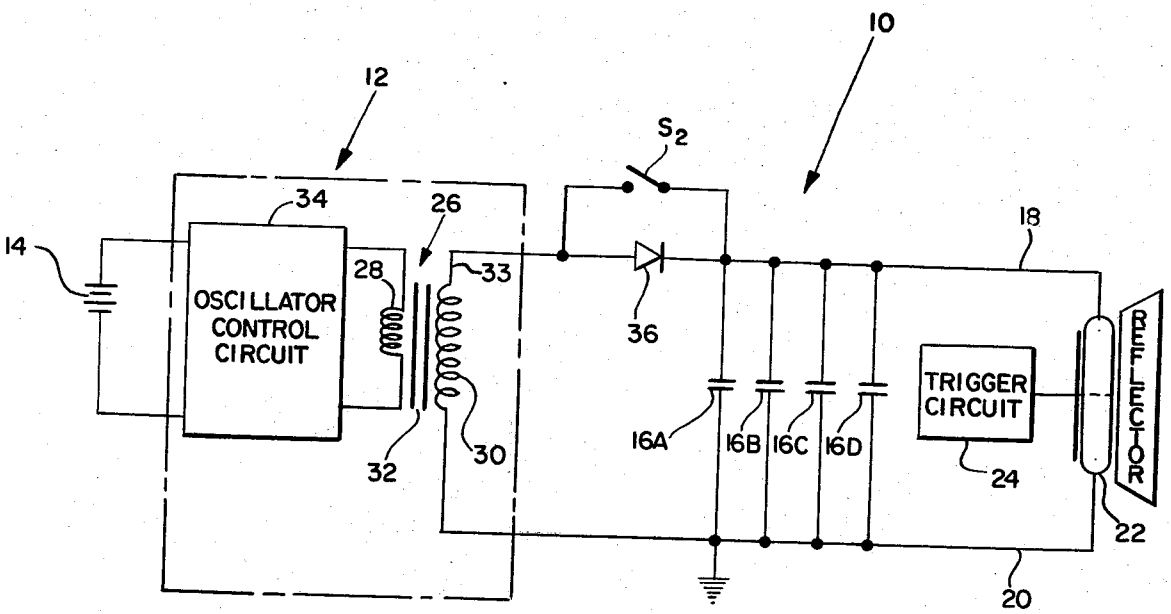
FIG. 1 is a circuit diagram for an electronic flash embodying the safety switch feature of this invention.

Referring now to FIG. 1, there is shown a schematic diagram for an electronic flash device 10 of the type preferably used for illuminating a scene or subject to be photographed. The flash device 10 includes a DC-to-DC converter as shown generally at 12 which may be powered by a direct current, low voltage, source such as a battery 14. A plurality of flash storage capacitors as shown at 16A through 16D are connected between a positive conductor as shown at 18 and a ground conductor as shown at 20 which, in turn, are connected to receive the output current from the oscillator 12. Thus, the oscillator 12 furnishes charging current to the storage capacitors 16A through 16D so that the output voltage from the oscillator increases in correspondence with the charging of the storage capacitors.

There is also provided a flashtube 22 in parallel relation with respect to the storage capacitors 16A through 16D. The capacitors 16A through 16D may be selectively discharged through the flashtube 22 to produce a flash for illuminating a photographic subject in a well-known manner. Such a selective discharge of the storage capacitors 16A through 16D through the flashtube 22 may be accomplished by a triggering circuit 24 shown in the drawing in block diagram form. The triggering circuit 24 may be of any suitable circuitry known in the art for triggering flashtube 22.

The oscillator 12 may be of any of the known types of oscillators customarily employed for charging capacitors and is shown to include a transformer 26 having a primary winding 28, a secondary winding 30, and a magnetic core 32. A feedback winding (not shown) may also be included and will operate in a well-known manner in conjunction with an oscillator control circuit 34 to energize the primary winding 28 with an alternating voltage derived from the DC voltage applied by the battery 14. The secondary winding 30 of the transformer 26 provides an alternating voltage stepped up from the alternating voltage of the primary winding 28 to provide the charging current to the capacitors 16A through 16D. The upper terminal of the secondary winding 30 as shown at 33 is connected through a diode 36 to the positive conductor 18 in order to provide a unidirectional charging current to the storage capacitors 16A through 16D.

Operation of the circuit may proceed as follows. As is readily apparent, closure of a switch $S_1$ will start the operation of the oscillator 12 so as to charge the capacitors 16A through 16D to a voltage well above the voltage of the battery 14. Thus, the oscillator operates to transfer the energy of the battery 14 progressively to the capacitors 16A through 16D whereby the capacitors charge and the voltage between the positive conductor 18 and the ground conductor 20 rises progressively with time in the usual manner. The specific manner in which the oscillation of the oscillator 12 causes the charge in voltage on the capacitors 16A through 16D to rise progressively with time is well known in the art and not relative to the instant invention. For purposes of illustration, it will be assumed that the DC battery voltage is in the order of 6 volts and that the maximum voltage to which the capacitors 16A through 16D are charged is in the order of 360 volts. After the capacitors 16A through 16D have been fully charged, the flashtube 22 may be triggered by way of the trigger circuit 24 in the usual manner during a photographic exposure interval to provide the desired flash of artificial illumination.

Figure 2A:
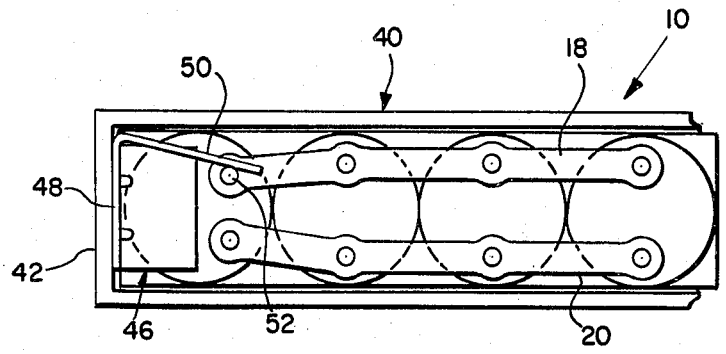
FIG. 2A is a top plan view of the electronic flash of FIG. 2 with the cover portion of the housing removed.
Figure 2:
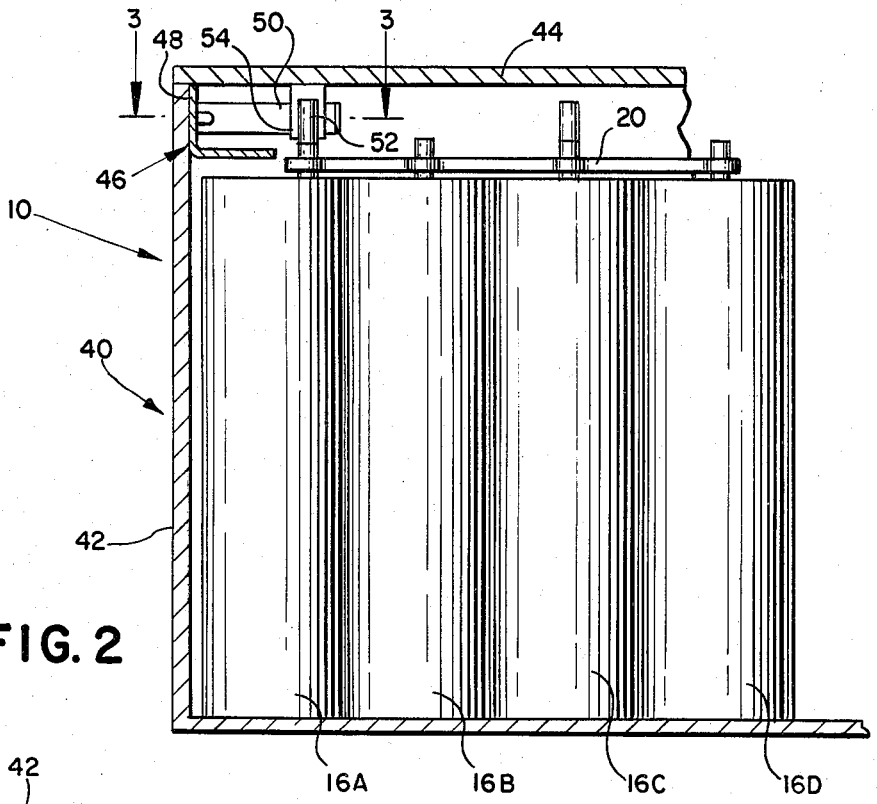
FIG. 2 is a front elevation cross-sectional view showing an electronic flash embodying the safety switch feature of this invention.
Figure 3:
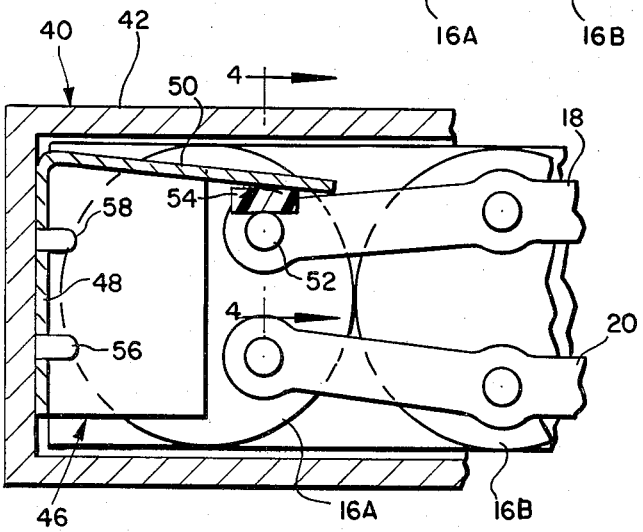
FIG. 3 is a cross-sectional view of a portion of FIG. 2 taken across the lines 3—3.
Figure 4:
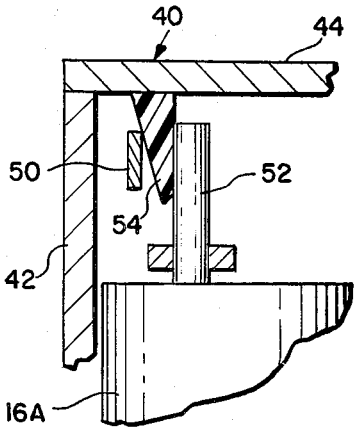
FIG. 4 is a cross-sectional view of a portion of FIG. 3 taken across the lines 4—4.

A safety switch $S_2$ is provided in parallel relation with respect to the diode 36 in order to discharge the capacitors 16A through 16D for purposes of safety. The electronic components as shown schematically in FIG. 1 are stationed within a housing 40 as best shown in FIGS. 2 through 4. The housing 40 comprises a main body portion, part of which is shown at 42, and a cover portion, part of which is shown at 44, which may be releasably connected with respect to the main body portion 42 by any well-known fasteners such as screws, snaps or the like. As will be readily understood, the housing 40 may contain only the electronic flash components shown in FIG. 1 and thus be adapted for releasable connection to a camera in a well-known manner or, alternatively, the housing 40 may contain both the electronic flash components of FIG. 1 together with all the other components of a photographic camera as is also well known in the art.

The safety switch $S_2$ may be constructed from a stamped metal terminal as shown at 46 electrically connected to the upper terminal 33 of the secondary winding 30 and including a right angle bend portion 48 from which extends a cantilevered leaf spring contact 50 resiliently biased to contact an upstanding terminal post 52 in electrical connection to the positive conductor 18. The right angle bend portion 48 is fastened to the main body portion by two integral prongs 56 and 58 which project laterally outward from the main body portion 42 into corresponding holes in the right angle bend portion 48. The cover portion 44 includes an integral rigid wedge-shaped finger 54 extending downwardly therefrom into intervening relationship between the leaf spring contact 50 and the terminal post 52 when the cover portion 44 is connected to the main body portion 40 in the aforementioned manner.

Thus, the safety switch $S_2$ is mounted for movement between an open circuit condition when the cover portion 44 is connected to the main body portion 42 as a result of the leaf spring contact 50 being yieldably urged out of electrical contact from the terminal post 52 by the downwardly extending wedge-shaped finger 54, and a closed circuit condition electrically interconnecting the upper terminal 33 of the secondary winding 30 of the transformer 26 to the positive conductor 18 as a result of the cover portion 44 being separated from the main body portion 42 so as to allow the leaf spring contact 50 to move against the terminal post 52. Thus, there is established a discharge path for the storage capacitors 16A through 16D through the secondary winding 30 of the transformer 26 to rapidly discharge the high voltage and remove any potentially harmful energy stored in the capacitors 16A through 16D. As is readily apparent, the bleeder resistor as required in the prior art to discharge the storage capacitor is thus eliminated to provide the result and economy in space and cost.

Although the safety switch $S_2$ of this invention has been shown for use with an electronic flash of the type having a plurality of storage capacitors 16A through 16D, it will be readily apparent that the number of storage capacitors in the electronic flash is not relevant to the use of this invention and the safety switch $S_2$ may be utilized with an electronic flash having any number of storage capacitors.

Thus, since certain changes may be made in the above-described system and apparatus without departing from the scope of the invention herein involved, it is intended that all matter contained in the description thereof or shown in the accompanying drawings shall be interpreted as illustrative and not in a limiting sense.

What is claimed is:

1. In an electronic flash apparatus of the type comprising a flash discharge tube; a storage capacitor; means responsive to an applied voltage for charging the storage capacitor including a transformer having a primary winding energized with an alternating voltage derived from the applied voltage and a secondary winding energized with an alternating voltage to provide a charging current to the storage capacitor; circuit means responsive to an applied trigger signal for discharging the storage capacitor through the discharge tube to produce an illuminating flash of light; and a housing having a main body portion for supporting the flash discharge tube, the storage capacitor, the charging means and the circuit means; and a cover portion which may be removably connected to the main body portion to cover at least the storage capacitor, the charging means and the circuit means, the improvement comprising:

safety switching means for discharging the storage capacitor in response to removal of the cover portion of the housing from the main body portion, said switching means being stationed with respect to the housing so as to assume an open circuit condition when the cover portion of the housing is connected to the main body portion and a closed circuit condition when the cover portion of the housing is disconnected from the main body portion, said switching means also being electrically connected with respect to the secondary winding of the transformer and the storage capacitor so as to establish a discharge path for the storage capacitor through the secondary winding when said switching means is in its closed circuit condition.

2. The improvement of claim 1 wherein one terminal of the secondary winding of the transformer is connected to the positive terminal of the storage capacitor through a diode in order to provide a unidirectional charging current and wherein said safety switching means is electrically connected in parallel relation with respect to the diode.

* * * * *